US006533070B1

(12) United States Patent
Elrod

(10) Patent No.: US 6,533,070 B1
(45) Date of Patent: Mar. 18, 2003

(54) ROOF BUDDY

(76) Inventor: Richard L. Elrod, 4090 N. 10th St., Haines City, FL (US) 33844

( * ) Notice: Subject to any disclaimer, the term of this patent is extended or adjusted under 35 U.S.C. 154(b) by 0 days.

(21) Appl. No.: 10/006,546

(22) Filed: Dec. 4, 2001

(51) Int. Cl.[7] ..... E06C 7/12

(52) U.S. Cl. ..... 182/103; 182/117; 182/45; 182/223

(58) Field of Search ..... 182/45, 117, 141, 182/102, 103, 223

(56) References Cited

U.S. PATENT DOCUMENTS

| | | | | | |
|---|---|---|---|---|---|
| 287,042 | A | | 10/1883 | Milliken | |
| 683,890 | A | | 10/1901 | Wolfe | |
| 1,361,828 | A | * | 12/1920 | Clowes | 182/27 |
| 1,494,489 | A | * | 5/1924 | Jones | |
| 2,338,833 | A | | 1/1944 | Bailey | 227/33 |
| 2,426,825 | A | * | 9/1947 | Geary | |
| 2,438,791 | A | * | 3/1948 | Russell | |
| 3,428,145 | A | | 2/1969 | Lyon | 182/103 |
| 3,476,212 | A | | 11/1969 | Eakins | 182/103 |
| 3,891,062 | A | * | 6/1975 | Geneste | 187/245 |
| 4,015,685 | A | * | 4/1977 | Lenz | 182/145 |
| 4,183,423 | A | | 1/1980 | Lewis | 182/103 |
| 4,306,700 | A | | 12/1981 | Bell | 248/238 |
| 4,546,853 | A | | 10/1985 | Hanson | 182/103 |
| 5,033,584 | A | | 7/1991 | Battle | 182/168 |
| 5,339,922 | A | * | 8/1994 | Beechler | 182/188 |
| 6,076,621 | A | | 6/2000 | Horn | 180/19.2 |
| 6,250,426 | B1 | * | 6/2001 | Lombard | 182/146 |

* cited by examiner

*Primary Examiner*—Alvin Chin-Shue
(74) *Attorney, Agent, or Firm*—Brian S. Steinberger; Law Offices of Brian S. Steinberger, P.A.

(57) ABSTRACT

Raisable and lowerable platforms for use with ladders that are laid against exterior and interior walls, and against other inclined surfaces such as pitched roof surfaces. Two or more ladders can each include the platforms which are controlled by motors to raise and lower in unison. The platforms can be attached by rollers about exterior sides of the ladders or on the interior sides of the ladders, as needed. Single, two, or more ladder applications can include platforms being expandable to have enlarged surfaces. A longitudinal member such as a board, deck, etc., can also be positioned on the platform(s) so it can be used as a raisable and lowerable scaffolding system.

8 Claims, 8 Drawing Sheets

1
93A
91A
98A
95A
99A
98B
95B
91B
93B
94
92
97A
96
41
50
51
20
10
28
15
55
16
99B
97B
45
40
84B
61
60
18
26
39
49
35
31
30
74B
74A
84A 60
10
28
F2
F1
40
53
63
81
71
50
83
20
26
80
15
16
70
73
60
55
29
18
27
25
1'

ROOF BUDDY

This invention relates to ladders, and in particular to a one, two or more ladder system for raising and lowering platforms and scaffolds on inclined surfaces such as walls and pitched roofs.

BACKGROUND AND PRIOR ART

Ladders have been used for a variety of job functions from painting walls, cleaning windows, to bringing supplies, such as roofing materials, up to a roof. However, moving materials such as paint cans and brushes and roofing supplies such as shingles and tar, etc. has generally required the worker to physically climb the ladder while simultaneously lifting the supplies with one hand. Clearly, this traditional approach has limitations as to the amount of supplies that can be brought up at any given time. Additionally, having to both lift supplies and climb can be dangerous to the worker when accidents occur. Still furthermore, traditional ladders have not space for storing supplies thereon so that the worker is free to use both their hands. Furthermore, the ladder must often be moved from place to place constantly for many job projects. For example, when painting sides of a building the painter using a single ladder must physically climb down the ladder, move the ladder, a reclimb up the ladder when painting along the side of the building. Also, constantly climbing ladders, and having to physically raise supplies can be dangerous since workers can fall, and persons on the ground adjacent to the ladders can become hurt if something falls on them.

Additionally, the inventor knows of no device or system which would allow a worker to move supplies up other surfaces such as a pitched roof surface when roof shingling is taking place without requiring the worker(s) have to physically lift and carrying the supplies. Thus, traditional pitched roofs are often dangerous places to work since workers must constantly be physically climbing and lifting supplies, and the workers can fall, and persons on the ground adjacent to the ladders can become hurt if something falls on them.

Patents have been proposed over the years for allowing materials to be elevated up the sides of ladders with cranks and motors. See for example, U.S. Pat. No. : 287,042 to Milliken; U.S. Pat. No. 683,890 to Wolfe; U.S. Pat. No. 2,338,833 to Bailey; U.S. Pat. No. 3,428,145 to Lyon; U.S. Pat. No. 3,476,212 to U.S. Pat. No. Eakins; 3,891,062 to Geneste; U.S. Pat. No. 4,183,423 to Lewis; and U.S. Pat. No. 4,546,853 to Hanson. However, these elevator type devices are limited to being used with single ladders, and do not provide any type of work platform that worker(s) can stand and support supplies thereon. Also, these patents are limited to being used on the exterior sides of the ladders which makes them unstable since the supported weight can twist and shift the ladder's position. Also, none of these devices show any use on other surfaces such as on pitched roof surfaces.

Other patents have been proposed that use two ladders with a plank between them. See for example, U.S. Pat. No. 5,033,584 to Battle, FIG. 5. However, this patent is limited to the user having to physically raise and lower the scaffolding platform which can become tedious and time consuming. One patent U.S. Pat. No. 4,306,700 to Bell proposes a type of chain assembly to hold a platform. However, the chains can damage the rungs and are not practical for long-term use, and the platform(s) must individually be moved and positioned each time a different level is needed.

U.S. Pat. No. 6,076,621 to Horn describes a motorized cart having a moveable platform. However, this device uses small caster type wheels that cannot be easily moved over rough and uneven terrain that exists around buildings and homes, etc. Also, the cart requires a completely level surface in order to effectively operate. Furthermore, the cart does not make use of conventional ladders that most workers have access to.

Similar to the single ladder problems, none of the double ladders allow for the moveable platforms to be on the inside surface of the ladder that is leaning against a wall. Still furthermore, none of the double ladders allow for use on raising and lowering supplies, and people, etc. on other inclined surfaces such as but not limited to pitched roof surfaces, and the like.

SUMMARY OF THE INVENTION

A primary objective of the invention is to provide an automatic system for simultaneously raising and lowering scaffolding platforms with two or more ladders.

A secondary objective of the invention is to provide an automatic system for raising and lowering scaffolding platforms that can be placed on uneven terrain.

A third objective of the invention is to provide a moveable platform system that can attach on the inside surfaces of a ladder leaning against a structure to allow for greater stability and safety when being used to raise and lower supplies and people A fourth objective of the invention is to provide a moveable platform system that can be used on a pitched roof surface to raise and lower supplies and people.

A fifth objective of the invention is to provide a moveable platform for ladders that can be enlarged as needed, so that greater amounts of supplies can be used, and more workspace is available, and potentially more workers can use the platform when needed.

A sixth objective of the invention is to provide a moveable platform that can be used with most conventional ladders on the market today, such as single length ladders, extension ladders, large step ladders, and the like.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figure 1:
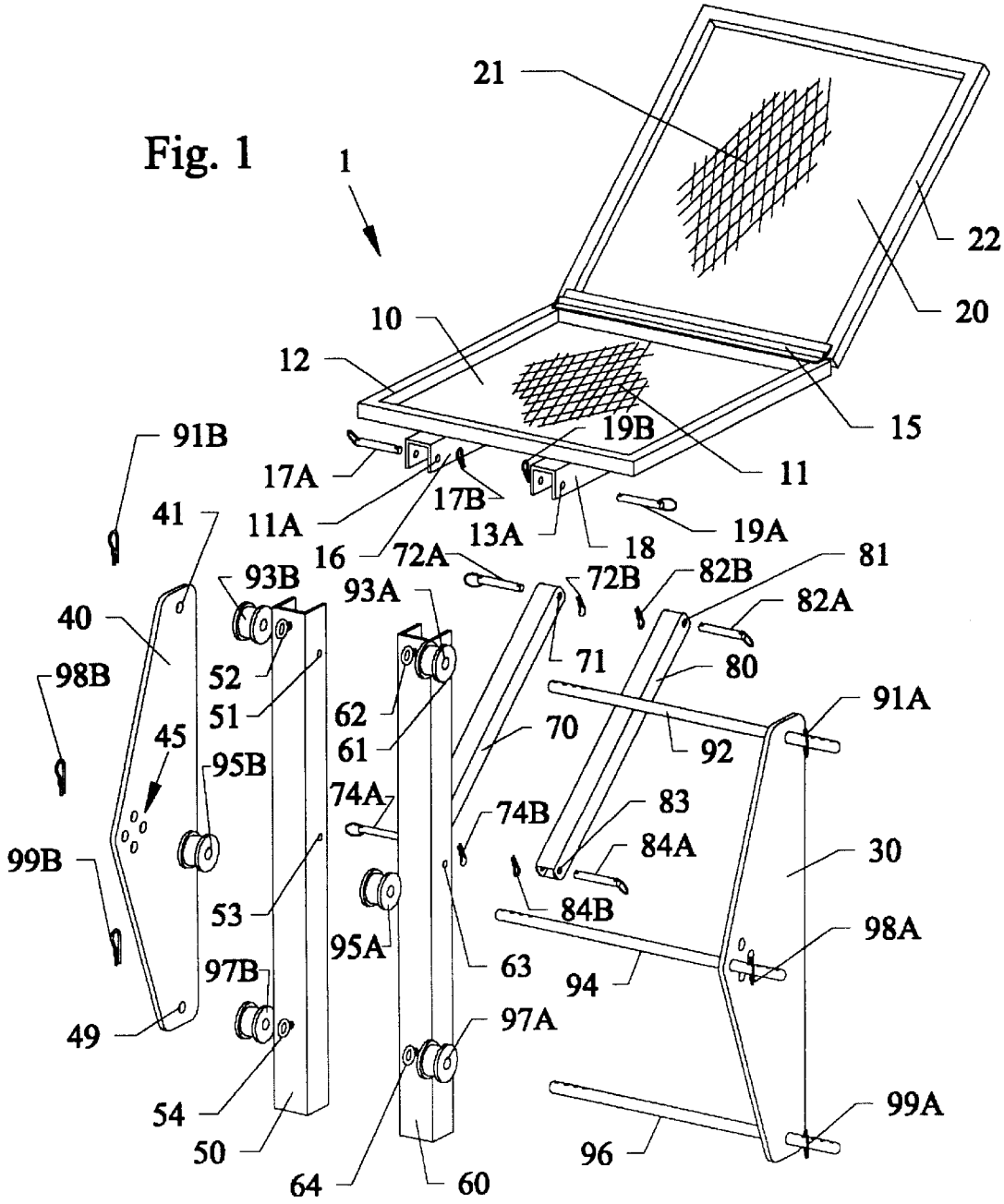
FIG. 1 is an exploded view of a moveable platform invention for use with ladders.
Figure 2:
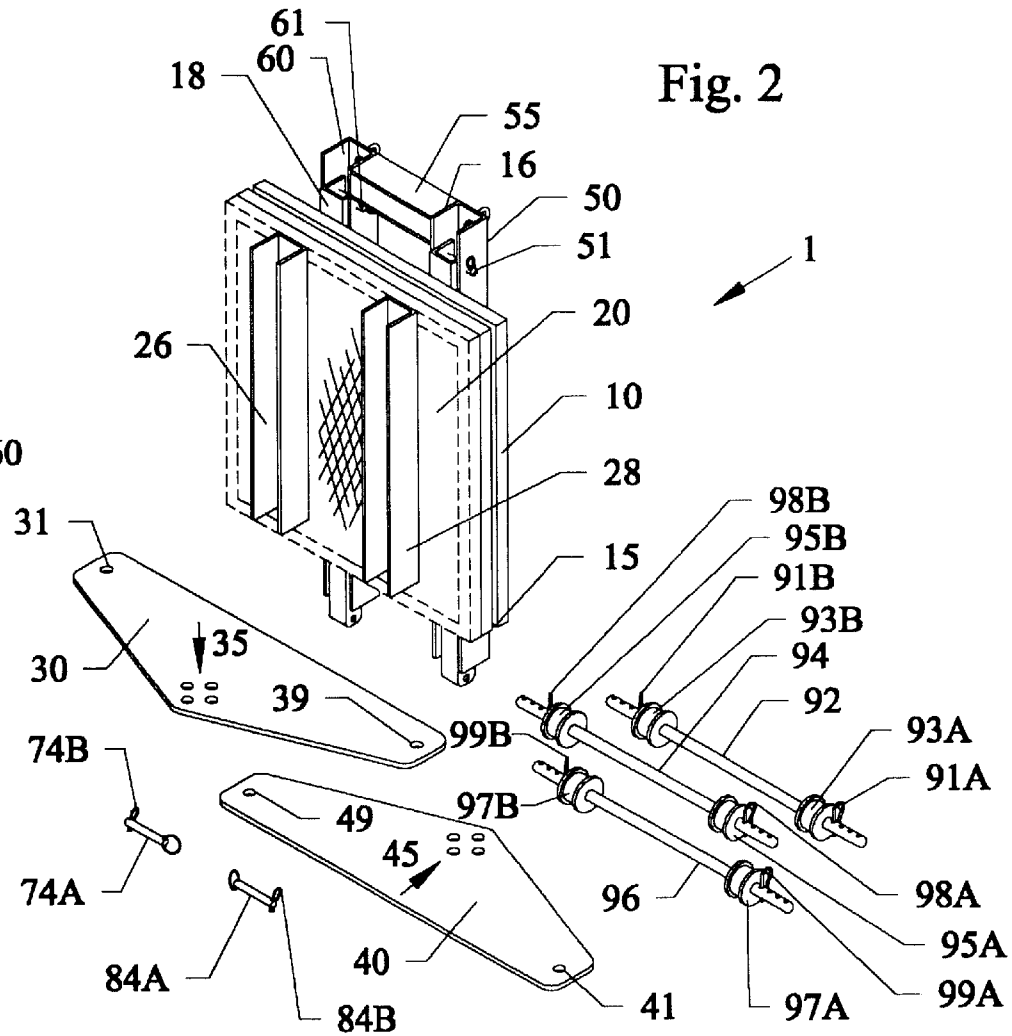
FIG. 2 is a partial assembled view of the components of the platform of FIG. 1.
Figure 3:
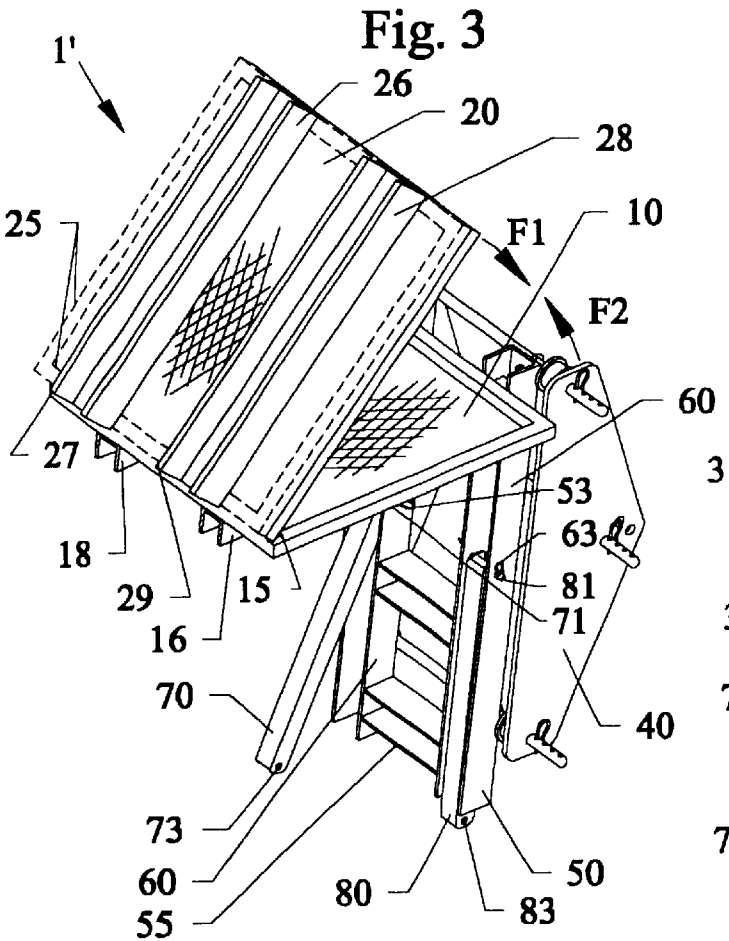
FIG. 3 is an assembled view of the platform components of FIGS. 1–2.

FIG. 1 is an exploded view of a moveable platform invention 1 for use with ladders. FIG. 2 is a partial assembled view of the components of the platform I of FIG. 1. FIG. 3 is an assembled view 1' of the platform components of FIGS. 1–2.

Referring to FIGS. 1–3, platform 1 includes main platform 10 that can have a rectangular shape with screen mesh central portion 11 within a four sided frame 12. Longitudinal U-shaped channel parallel main platform braces 16, 18 attached to an underside portion provide structural support for main platform 10. Rear ends of braces 16, 18 have through-holes 11A, 13A therethrough, are positioned to fit within end portions of respective longitudinal U-shaped channel lift braces 50, 60 so that through-holes 51, 61 of lift braces 50, 60 line up with through-holes 11A, 13A, respectively, of main platform braces 16, 18. And the through-holes 13A, 61 and 11A, 51 allow for retainer pins 17A, 19A to be inserted therein and held in place by clips 17B, 19B, respectively.

Additional extension platform 20 includes a rectangular shape with screen mesh central portion 21 within a four sided frame 22. Extension platform 20 is attached to main platform 10 by a hinge 15, so that extension platform when not being used is folded in a sandwich orientation with main platform 10, as shown in FIG. 2. Extension platform 20 can include on an underside portion longitudinal U-shaped channel parallel extension platform braces 26, 28. As extension platform is being unfolded in the direction of arrow F2 as shown in FIG. 3, ends 27, 29 of the underside extension platform braces 26, 28 abut against ends of main platform braces 18, 16, respectively. Alternatively, a lower edge protruding rim 25 such as a bent edge can be used on the underside perimeter edge of the extension platform 20 so that the protruding rim abuts against ends of the main platform braces 18, 16. Folding extension platform 20 in the direction of arrow F1 allows for the platforms 10, 20 to be folded together, as shown in FIG. 2.

Figure 4:
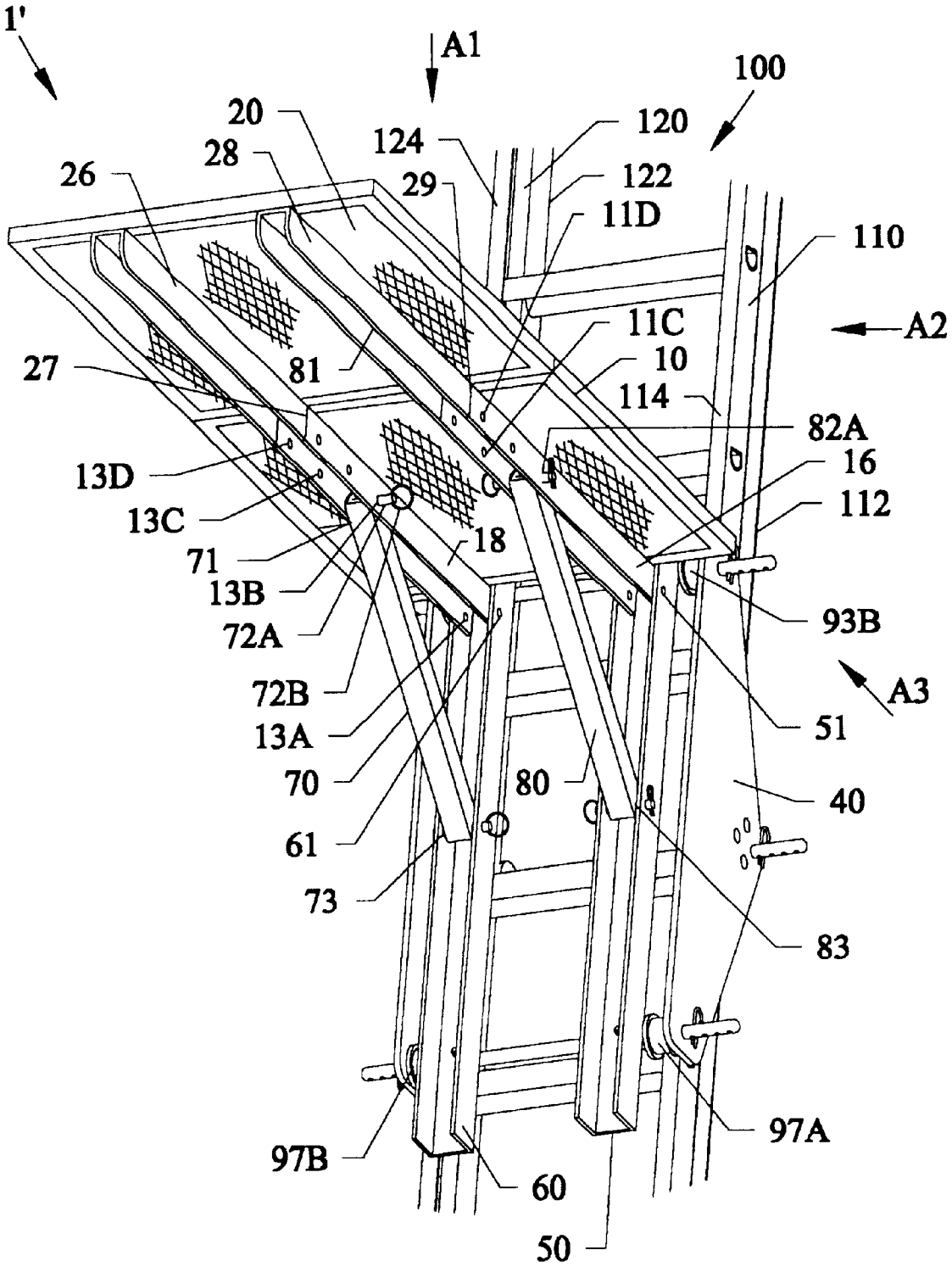
FIG. 4 is a perspective view of the assembled platform used with a single ladder.

FIG. 4 is a perspective view of the assembled platform 1' having a main platform 10 with the extension platform 20 in an unfolded position used with a single extension ladder 100.

Referring to FIGS. 1–4, lift braces 50, 60 can include additional through-holes 53, 63 located along a midportion of each brace so that lower end through-holes 73, 83 of respective main platform lifting struts 70, 80 can be lined up and rotatably held together by pins 74A, 84A and respective retainer clips 74B, 84B. Upper end through-holes 71, 81 of lifting struts 70, 80 are lined up with through-holes 13B, 11B of main platform braces 16, 18 and also held in place by respective pins 72A, 82A, and clips 72B, 82B, respectively. An optional cross-brace bar(s) 55(up to three or more) can be welded to both lift braces 50, 60 to maintain the lift braces 50, 60 in a fixed parallel orientation to one another. Substantially triangular shaped end plates 30, 40 each include upper flat tipped ends having respective through-holes 31, 41 therethrough, a peak midportion area with respective plural through-holes 35, 45 therethrough, and lower flat-tipped ends having respective through-holes 39, 49 therethrough.

Three sets of roller axles 92, 94, 96 each having a two raised edge rollers 93A & 93B, 95A & 95B, and 97A & 97B can be inserted over the axles. The rollers are held on the axles by respective pairs of clip type cotter pins 91A & 91 B, 98A & 98B, and 99A & 99B which insert into through-holes in ends of each of the axles 92, 94, and 96, after the axles have been positioned within the corresponding upper through-holes 41, 31, midportion through-holes 45, 35 and lower through-holes 49, 39 of the end plates 40, 30. Axles 92 and 96 also fit into respective upper rearwardly extending loop fasteners 52, 62 and lower rearwardly extending loop fasteners 54, 64 of lift braces 50, 60 so that the end plates 30, 40 are positioned outside lift braces 50, 60.

Figure 5A:
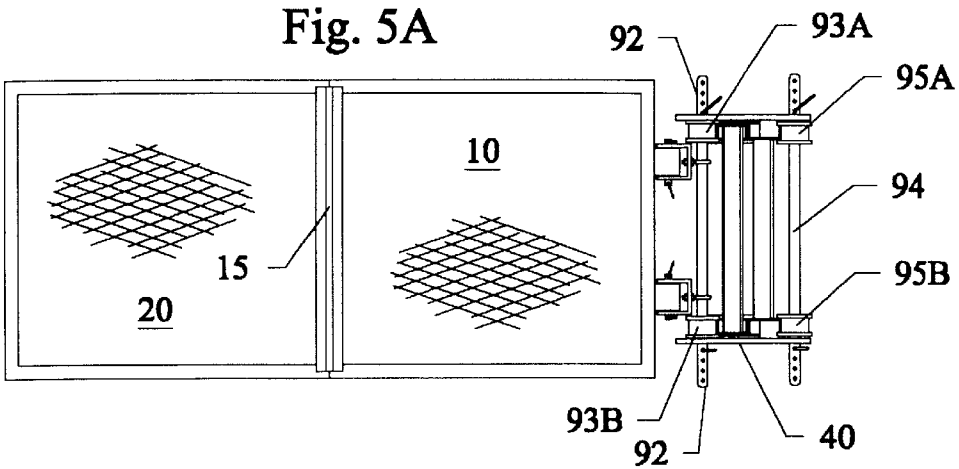
FIG. 5A is a top view of the platform and ladder of FIG. 4 along arrow A1.
Figure 5B:
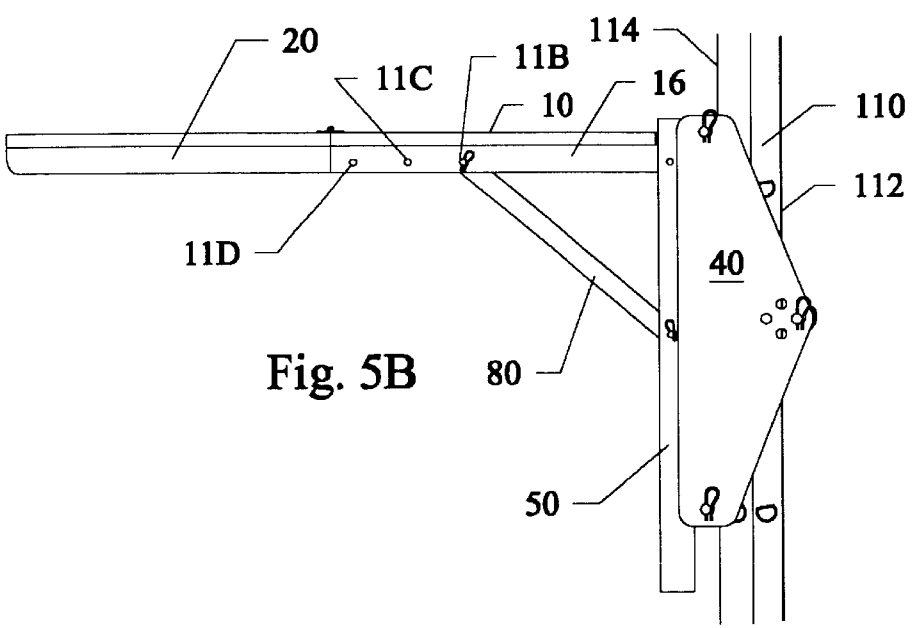
FIG. 5B is a side view of the platform and ladder of FIG. 4 along arrow A2.
Figure 5C:
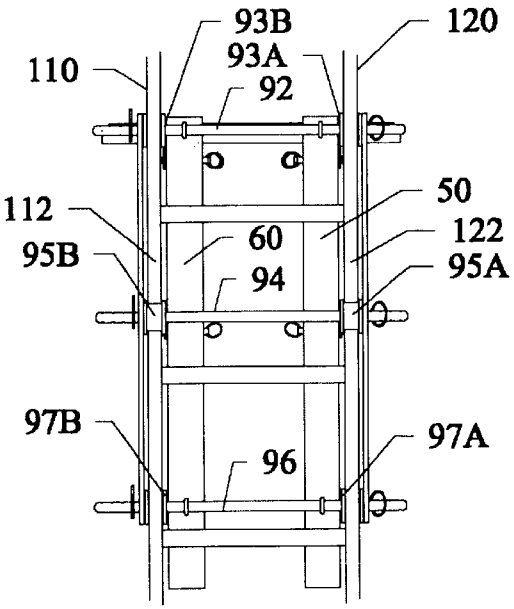
FIG. 5C is a rear view of the platform and ladder of FIG. 4 along arrow A3.

FIG. 5A is a top view of the main platform 10 and extension platform 20 and ladder 100 of FIG. 4 along arrow A1. FIG. 5B is a side view of FIG. 4 along arrow A2. FIG. 5C is a rear view of FIG. 4 along arrow A3.

Referring to FIGS. 4 and 5A–5C, upper raised edge rollers 93A, 93B can be positioned to ride about and against exterior outer edges 114, 124 of legs 110, 120 of the extension ladder 100, while middle raised edge rollers 95A, 95B can be positioned to ride about and against the other side edges 112, 122 of legs 110, 120 of the extension ladder 100, and lower raised edge rollers 97A, 97B can be positioned to ride about and against exterior outer edges 114, 124 of legs 110, 120 of the extension ladder 100.

Figure 6:
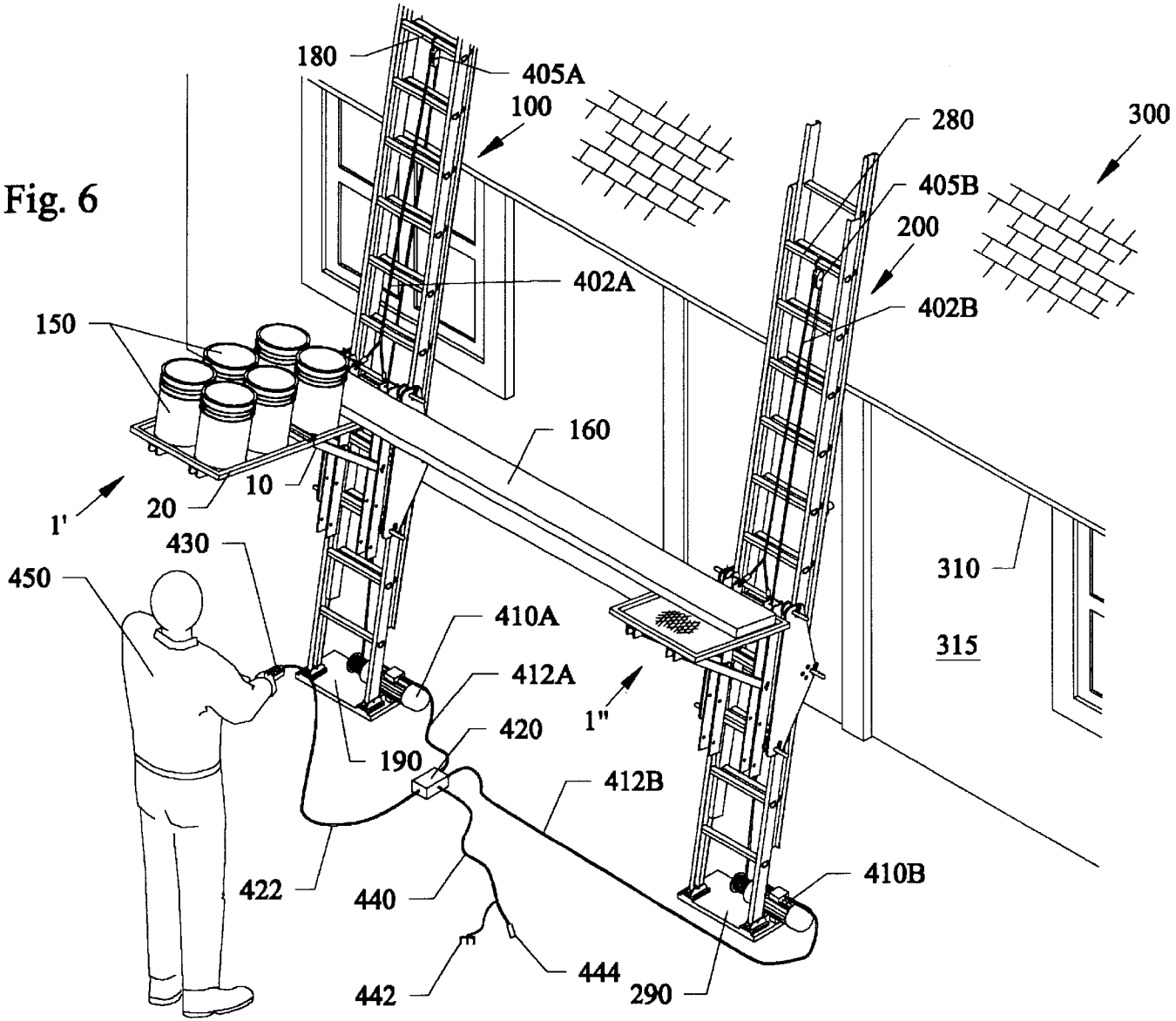
FIG. 6 is a perspective view of using two invention platforms on exterior sides of two ladders positioned against the side of a building.
Figure 7:
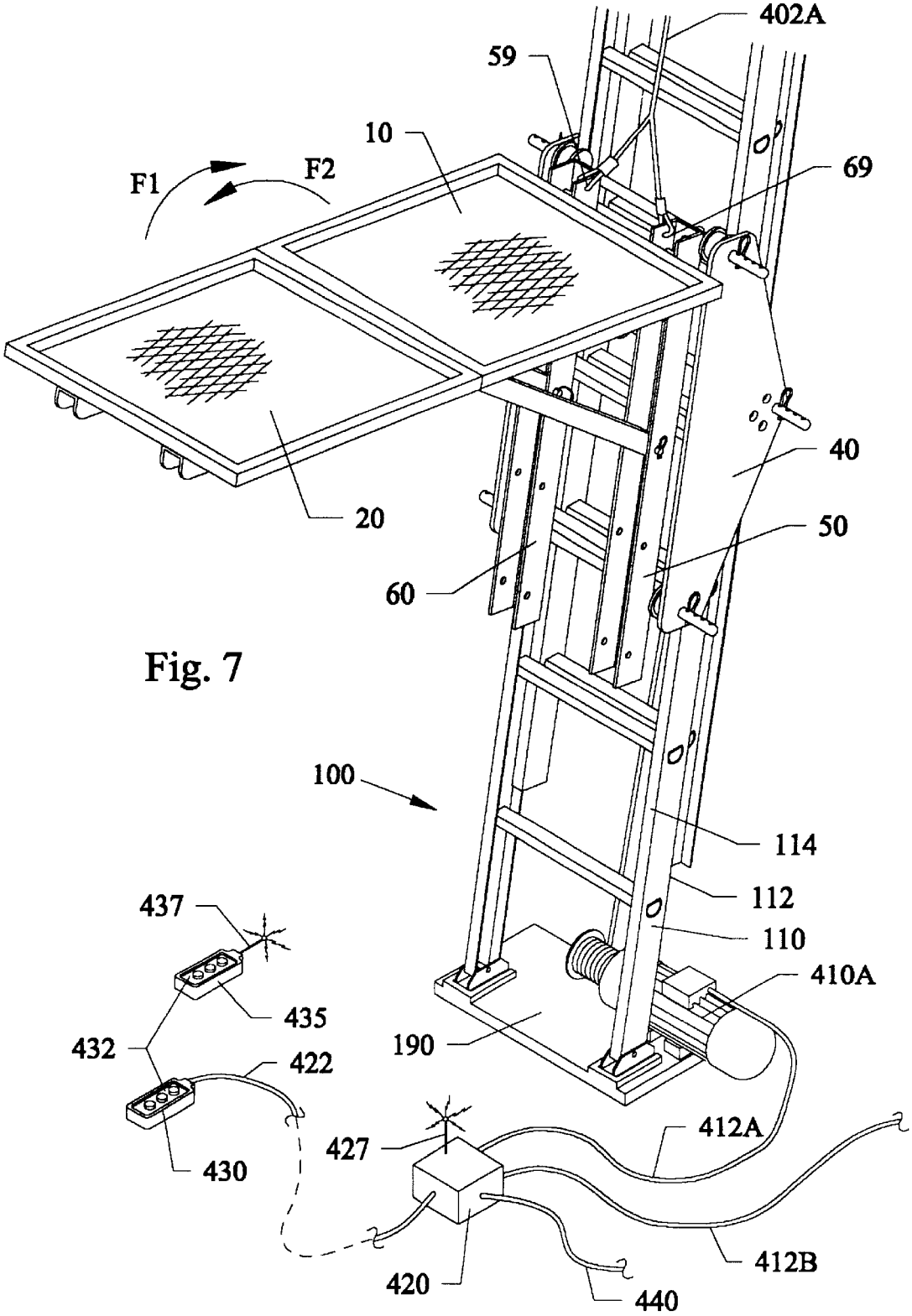
FIG. 7 is an enlarged perspective view of a single platform and ladder from FIG. 6.

FIG. 6 is a perspective view of using two invention platforms 1', 1" on exterior sides of two ladders 100, 200 positioned to lean against the side, such as gutter edge 310 on an upper edge of an exterior wall, of a building 300. FIG. 7 is an enlarged perspective view of a single main platform 10 and extension platform 20 and ladder 100 from FIG. 6.

Referring to FIGS. 6–7, supplies 150, such as but not limited to paint cans, and roofing tar, can be supported by main platform 10 and extension platform 20. A longitudinal member 160 such as a plank can be positioned across both assembled platforms 1' and 1", respectively, so that it can be used as a scaffold type support.

A lift cable 402A, 402B can be attached to each of the assembled platforms 1', 1". For example, extra through-holes 59, 69 can be positioned on upper ends of braces 50, 60 to attach a cable line 402A. Alternatively, the line 402A can be attached to one of the cross-brace(s) 55. Pulleys on upper rungs 180, 280 of each ladder 100, 200 allow the respective cable type lines 402A, 402B to pass the respective cable lines to winch motors 410A, 410B that are respectively mounted on base plates 190, 290 of the respective ladders 100, 200. Alternatively, the motors 410A, 410B can be mounted on the ladder rungs, such as the lowest(first) rung of the respective ladders. Furthermore, one motor can be used to supply power for both ladders. Alternatively, the base plates 190, 290 can be mounted on the sides of the ladders 100, 200, if needed. A dual winch junction box 420 connects the power feed lines 412A, 412B to the respective winch motors 410A, 410B. A handheld control 430 can be held by worker 450. Power supply can be from a power cord 440 which has one end which connects to joint box 420 and opposite ends 442 for allowing the dual motors to be plugged into conventional 120 volt power household power supplies. Alternatively, an automobile cigarette lighter plug 444 can allow the invention to powered by a 12 volt battery power supply. Toggle type switches 432 on the handheld control panel 430 allow the worker 450 to simultaneously run both winch motors 410A, 410B to raise and lower the assembled platforms 1' and 1" in unison.

Referring to FIG. 7, alternatively, a wireless control panel 435 having an antenna 437 which can send signals such as infrared, radio frequency, and the like, to antenna 427 on junction box 420, so that the platforms 1' and 1" can be remotely operated without the length limitation of control cord line 422.

Figure 8:
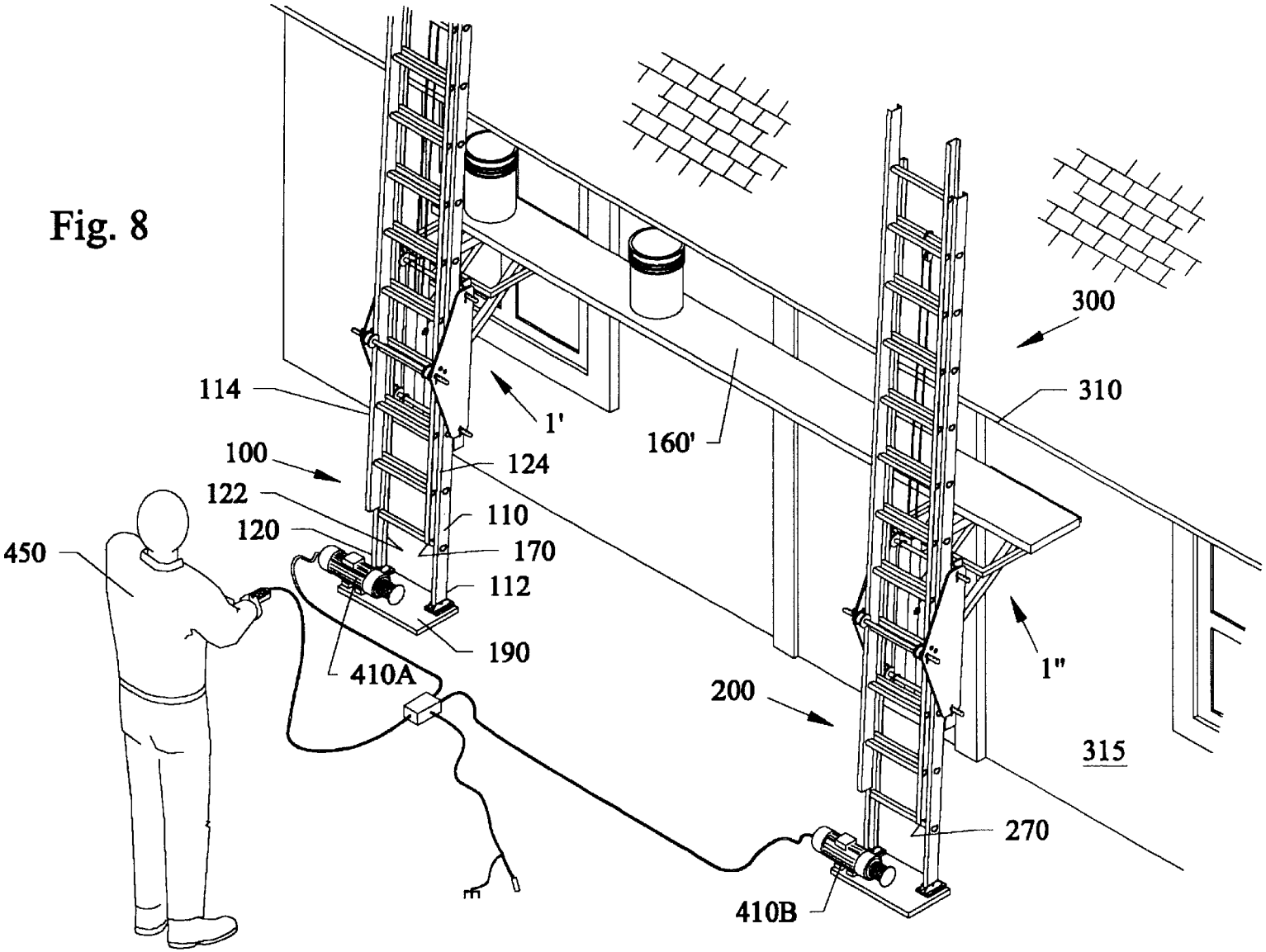
FIG. 8 is a perspective view of using two invention platforms on interior sides of two ladders positioned against the side of a building.

FIG. 8 is a perspective view of using two invention platforms 1', 1" on interior sides of two ladders 100, 200 positioned against the side 315 of a building. A scaffold platform 160' can be positioned between the ladders 100, 200 and the wall portion 315. The location of the rollers as described in reference to FIGS. 4 and 5A–5C would middle rollers 95A, 95B running against outer facing ladder leg edges 114, 124 and upper/lower rollers 93A, 93B, 97A, 97B running against interior wall facing ladder leg edges 112, 122.

The novel arrangement of the rollers, roller axles, and end plates 30, 40, allow for moving up and down over any location on the extension ladders 100, 200, including where extension portions 170, 270 are located.

Figure 9:
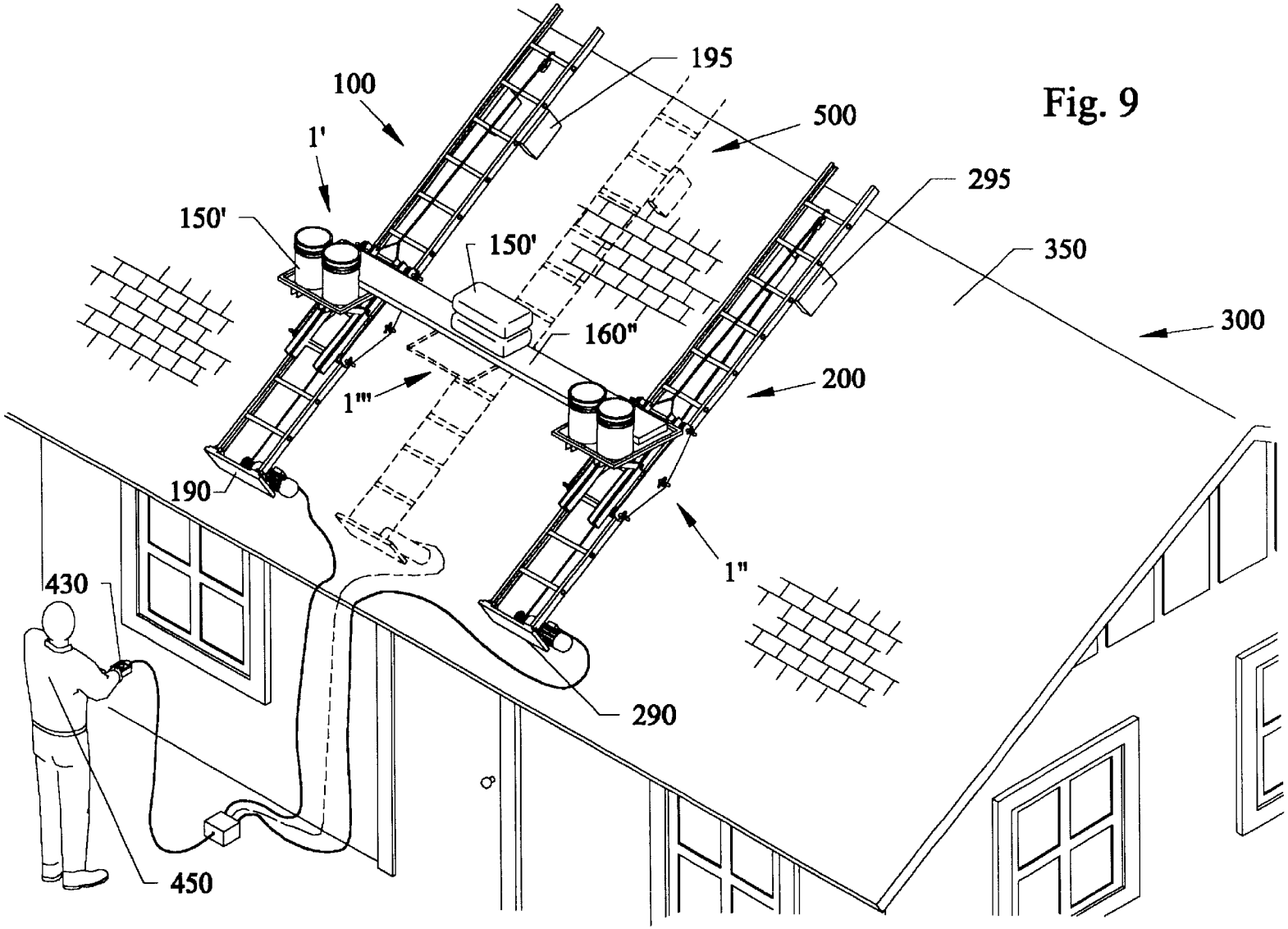
FIG. 9 is a perspective view of using two invention platforms and two ladders on a roof.

FIG. 9 is a perspective view of using two invention platforms 1' and 1" and two ladders 100, 200 on a roof 350. The ladders 100, 200 can be laid against a roof 350 each having a base plate 190, 290 and upper raised portion 195, 295 such as concrete blocks, benches, and the like, to raise the surface of the ladders 100, 200 off the roof surface 350. The novel platforms 1', 1" run up and down the respective ladders similar to the descriptions in the previous embodiments. Here, the main platform sections can be adjusted to tilt to compensate for the roof pitch.

Referring to FIGS. 4, 5B and 9, the lifting struts 70, 80 can be positioned to attach to the main platform braces 16, 18 by fitting into different through-holes 11B, 11C, 11D, and 13B, 13C, 13D as needed to provide a level surface for lifting roof supplies 150' on the platforms 1', 1" and scaffold 160". Additionally, a third or more ladders 500 can be used with additional moving platforms 1'", for allowing larger scaffolds to be used. Three or more moving platforms can also be similarly controlled so that they all move in unison up and down their respective ladders.

While the preferred embodiments show using the invention with extension type ladders, the invention has applicability to most ladders available on the market today, such as single position length ladders, step ladders, and the like.

Although the preferred embodiments show using two, three or more ladders with the subject invention, the subject invention especially the enlargeable platform can be used with a single ladder, as needed, with or without a longitudinal member on the platform, and with or without a motor control. For example, a crank control could be used with a single ladder application.

While the preferred embodiments show raising and lowering a board type member as a scaffold, the invention can raise and lower larger and smaller members such as but not limited to platforms large enough to support people, with or without rails, and the like.

Although the preferred embodiments show using the invention on the exterior of building type structures, the invention can be used in other applications such as but limited to inside of structures, against walls and other surfaces, and the like.

The invention can be used for various applications such as but not limited to lifting persons and materials. The materials can include but not be limited to roofing and siding materials, which can further include but not be limited to stucco, concrete, tar, shingles, siding, paint, wood, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A scaffolding system for two or more ladders, comprising in combination:

a first ladder laid against a raised surface;

a first moveable platform;

first means for attaching the first platform on the first ladder;

a first motor fixably mounted to a base portion of the first ladder;

a second ladder laid against the raised surface being spaced apart from the first ladder, the first ladder and the second ladder being spaced apart from and not mechanically attached to one another;

a second moveable platform;

second means for attaching the second platform on the second ladder;

a longitudinal member that is solely laid on both the first and the second platforms;

a second motor fixably mounted to a base portion of the second ladder; and control means for simultaneously controlling the first motor and the second motor for simultaneously moving the first platform and the second platform up and down on the first and the second ladders, wherein the longitudinal member functions as. a moveable scaffold.

2. The scaffolding system of claim 1, wherein the raised surface includes:

a wall.

3. The scaffolding system of claim 1, wherein the raised surface includes: a roof having a pitch.

4. The scaffolding system of claim 1, further comprising:

a third ladder laid against the surface between the first ladder and the second ladder, the third ladder separated from and not being mechanically attached to both the first ladder and the second ladder;

a third moveable platform;

a third motor fixably mounted to a base portion of the third ladder, wherein the longitudinal member is solely laid on the first, the second and the third platforms, and wherein the control means simultaneously moves the first, the second and the third platforms up and down on the first, the second and the third ladders as the moveable scaffold.

5. The enlargeable scaffolding system of claim 2, wherein the attaching means includes:

rollers for attaching the first platform on an exterior side of the first ladder, and the raised surface is a roof.

6. A raisable and lower enlargeable scaffolding system for ladders, comprising in combination:

a first ladder for being laid against a raised surface;

a first platform having a first layer in a folded sandwich orientation to a second layer, the folded sandwich orientation of the platform having a first upper surface area(being substantially parallel to a ground surface, the first upper surface area for supporting an object thereon;

hinge means for enlarging the first upper surface area of the platform by unfolding the second layer relative to the first layer to an expanded unfolded position having an enlarged upper surface area, the enlarged upper surface area being larger than the first upper surface area;

means for supporting the expanded unfolded position so that the enlarged upper surface area is substantially parallel to the ground surface;

means for attaching the first platform to the first ladder a motor mounted on a bottom portion of the first ladder for moving the first platform up and down on the first ladder.

7. The enlargeable scaffolding system of claim 6, wherein the attaching means includes:

rollers for attaching the first platform on an exterior side of the first ladder, and the surface is a wall.

8. The enlargeable scaffolding system of claim 6, erein the attaching means includes:

rollers for attaching the first platform on an interior side of the first ladder, and the raised surface is a wall.

* * * * *